US009581419B2

(12) United States Patent
Barker et al.

(10) Patent No.: US 9,581,419 B2
(45) **Date of Patent: *Feb. 28, 2017**

(54) PLASMA GAP DETONATOR WITH NOVEL INITIATION SCHEME

(71) Applicant: HALLIBURTON ENERGY SERVICES, INC., Houston, TX (US)

(72) Inventors: James Marshall Barker, Mansfield, TX (US); Tony Forbes Grattan, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1 day.

This patent is subject to a terminal disclaimer.

(21) Appl. No.: 14/319,402

(22) Filed: Jun. 30, 2014

(65) Prior Publication Data

US 2015/0330750 A1 Nov. 19, 2015

Related U.S. Application Data

(63) Continuation of application No. 14/350,331, filed as application No. PCT/US2013/035830 on Mar. 26, 2013, now Pat. No. 8,934,214.

(51) Int. Cl.
*F42B 3/13* (2006.01)

(52) U.S. Cl.
CPC ..... *F42B 3/13* (2013.01)

(58) Field of Classification Search
CPC ..... F42D 1/045; F42B 3/11; F42B 3/13
USPC ..... 361/248
See application file for complete search history.

(56) References Cited

U.S. PATENT DOCUMENTS

| | | | | |
|---|---|---|---|---|
| 4,708,060 | A | 11/1987 | Bickes, Jr. et al. | |
| 4,762,067 | A | 8/1988 | Barker et al. | |
| 4,939,993 | A | 7/1990 | Curutchet et al. | |
| 5,052,301 | A | 10/1991 | Walker | |
| 6,166,452 | A * | 12/2000 | Adams | F42B 3/198 307/10.1 |
| 6,408,759 | B1 | 6/2002 | Ewick et al. | |
| 6,640,718 | B2 * | 11/2003 | Duguet | F42B 3/13 102/202.5 |
| 7,004,423 | B2 | 2/2006 | Folsom et al. | |
| 7,690,308 | B2 | 4/2010 | Nielson et al. | |
| 2004/0261645 | A1 * | 12/2004 | Martinez-Tovar | F42B 3/13 102/202.9 |
| 2007/0169657 | A1 | 7/2007 | Kneisl | |
| 2009/0151584 | A1 | 6/2009 | Desai | |
| 2011/0072997 | A1 * | 3/2011 | Nance | F42B 3/103 102/202.7 |
| 2013/0284043 | A1 * | 10/2013 | Davis | F42B 3/18 102/202.7 |

OTHER PUBLICATIONS

International Search Report and Written Opinion dated Dec. 19, 2013 for Application No. PCT/US2013/035830.

* cited by examiner

*Primary Examiner* — Stephen W Jackson
*Assistant Examiner* — Christopher Clark
(74) *Attorney, Agent, or Firm* — Chamberlain Hrdlicka

(57) ABSTRACT

Disclosed is a method and apparatus for use in initiating explosives used in application including well perforating systems. The initiator uses an air gap separating an electrically triggered semiconductor bridge plasma energy creator and a reactive foil abutting an explosive.

6 Claims, 3 Drawing Sheets

PLASMA GAP DETONATOR WITH NOVEL INITIATION SCHEME

CROSS REFERENCE TO RELATED APPLICATIONS

U.S. application Ser. No. 14/350,331, to Barker, filed Apr. 7, 2014 which claims priority to PCT Application PCT/US2013/35830 filed Mar. 26, 2013.

BACKGROUND

Technical Field

The present inventions relate to improved reliability and safety of electrical initiators for explosive devices.

Background Art

Electro-explosive initiation devices are commonly used in the aerospace, military, automotive and oil and gas industries in explosive systems to perform perforating and cutting operations. These initiation devices act as the starting element to begin the explosive sequence.

Conventional Semiconductor Bridge (SCB) explosive devices utilize a semiconductor bridge element in intimate contact with an energetic material as an initiator. The bridge is used to covert electrical pulse energy into thermal energy which is then used to release the chemical energy of the energetic material. When sufficient electrical impulse is applied, the semiconductor bridge vaporizes, generating a rapid release of heated particles (plasma event). At the desired electrical energy level the plasma event initiates a chemical breakdown (deflagration reaction) in the surrounding energetic material if the material is of the type that is sensitive to plasma events.

Common electrical hazards for electroexplosive initiators include low level stray currents and RF signals. Unless protected by circuitry or other means such as electromagnetic shields, the electrical hazards could possibly induce current flow across the semiconductor bridge causing ohmic (resistance) heating of the bridge element. If the energetic material in contact with the bridge is sufficiently insensitive, it acts as a heat sink and thus allows the bridge to "burn out" in a passive manner without initiating a plasma event. In this instance the initiator is now in the dudded condition and not able to function. If the energetic material in contact with the bridge element is sufficiently sensitive, then the simple ohmic heating (i.e., not plasma heating) could cause chemical reaction thus initiating the electro-explosive device.

In prior art plasma devices, such as Halliburton's Rig Environment Detonator (RED®), the semiconductor bridge is in intimate contact with an insensitive pyrotechnic material. However, to further enhance its safety, the present invention calls for the semiconductor bridge element to be separated from the energetic material regardless of whether it is sensitive or insensitive. By introducing the separation, the effects of ohmic heating are removed. The separation gap, however, causes initiation by plasma heating to become less reliable since the hot plasma particles must traverse the gap and thus undergo cooling effects. If the gap is too great, the normal "plasma mode" of initiation will fail thus leading to a dudded device.

While plasma gap type initiators have improved safety characteristics, separating the semiconductor bridge from the energetic material produces a less reliable initiator. In addition plasma gap type initiators are limited in that the energetic material must be of the type that is sufficiently sensitive to plasma events.

Therefore there is a need for an initiator with improved safety and reliability and one that can be used with a wider variety of energetic materials.

SUMMARY OF THE INVENTIONS

The present inventions provide a plasma gap type initiator that has improved reliability and can be used with insensitive energetic materials.

The initiator of the present invention utilizes a plasma-event-creating semiconductor bridge element that is held spaced away from the energetic material by a mechanical spacer to create a gap between the bridge element and the material.

Another aspect of the present invention utilizes a reactive foil material positioned in the gap abutting the energetic material.

According to further aspect of the present invention the reactive layer abutting the explosive material is a plasma gap type initiator comprising reactive multi-layer foil.

According to an additional aspect of the present invention the reactive multi-layer foil comprises mutually exothermic reactive metals formed in thin layers where the exothermic reaction is initiated by a plasma event.

According to further aspect of the present invention, the reactive foil comprises Nanofoil®. NanoFoil® products are composed of multiple nano-layers of nickel and aluminum. Nanofoil foil is a product supplied by Indium Corporation.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing, in which.

DETAILED DESCRIPTION

The present invention provides an improved apparatus and method for igniting an energetic material. The present invention's particular applicability is to ignite devices used in wellbore applications.

Figure 1:
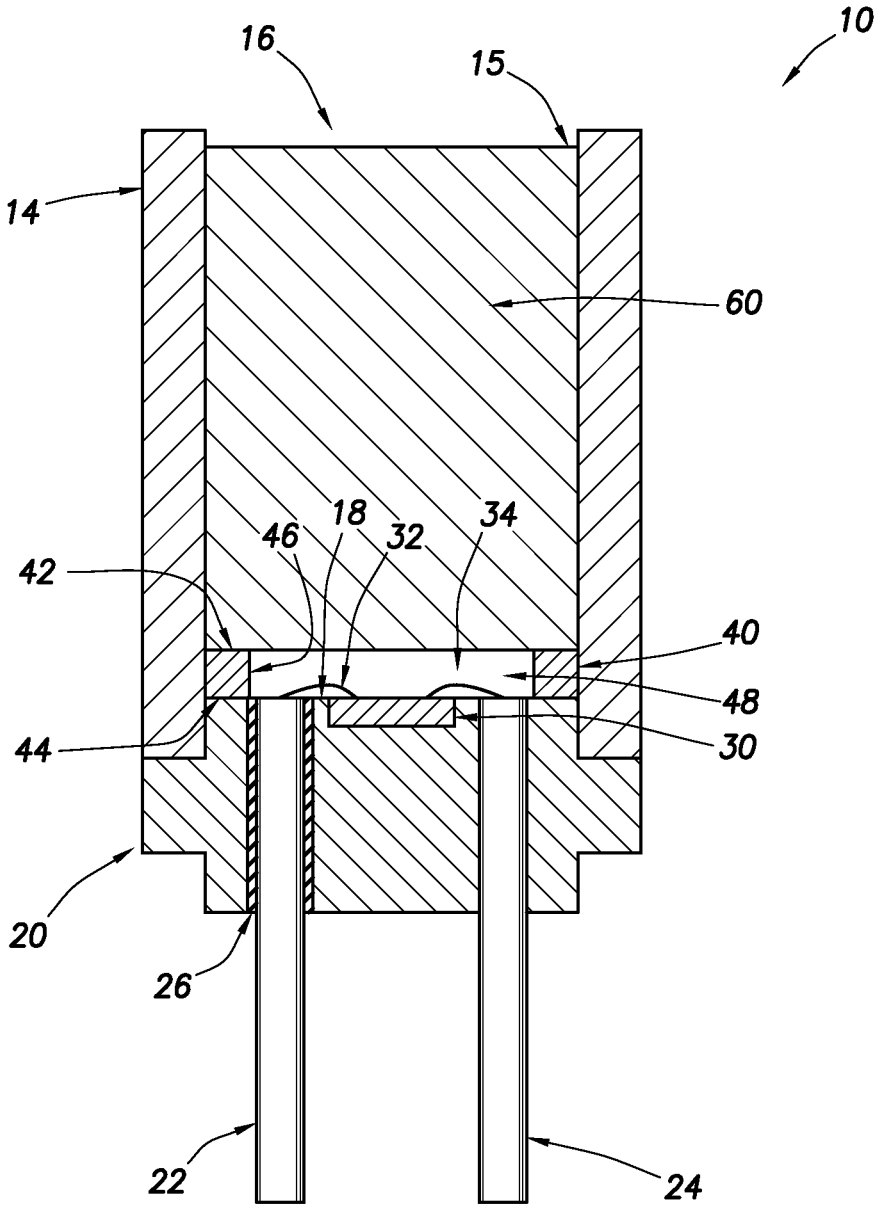
FIG. 1 is a diagram of the igniter system of the present invention illustrated in longitudinal section.

Referring more particularly to the drawing, wherein like reference characters are used throughout the various figures to refer to like or corresponding parts, there is shown in FIG. 1 one embodiment of the igniter system 10 of the present invention installed in a typical electro-explosive device.

The igniter system 10 is installed in an energetic device comprising a cylindrical shaped barrel 14 which has an interior chamber defined by a cylindrical inner wall 15. The barrel 14 is open on one end 16 (illustrated on the page as the upper end) and is closed off at the other end by end wall 18 formed on a header 20. The header 20 is attached to (or integrally formed with) the barrel 14 to form a rigid open ended housing. As will be described the open end 16 can be associated with a detonating cord of an explosive device such as a well bore perforating apparatus. In a different embodiment, it is possible for the upper end 16 of the barrel 14 to be sealed by a thin disc. The disc is sufficiently thin so as to not prevent functioning of the device.

Two lead wires 22 and 24 extend axially through the barrel 14. Lead wire 22 is electrically separated from the header by an insulating sleeve 26. A semiconductor bridge 30 is embedded in the wall 18 facing the interior of the barrel 14. A semiconductor bridge is used to refer to a device which when pulsed with sufficient electrical energy creates a plasma event. A typical semiconductor bridge (SCB) is described in U.S. Pat. No. 4,708,060 entitled "Semiconductor Bridge (SCB) Igniter", filed Feb. 19, 1985, issued Nov. 24, 1987, the disclosure of which is incorporated by reference into the specification of this application. The two leads 32 and 34 extending from the semiconductor bridge 30 are electrically connected to the leg wires 22 and 24.

The semiconductor bridge 30 is of the type which when pulsed with a sufficient electrical energy, vaporizes, generating a rapid release of heated particles (plasma event). However, if a stray electrical pulse of lesser energy is generated across the leg wires, the semiconductor bridge will not vaporize.

An annular spacer ring 40 abuts the header wall 18. The upper and lower annular faces 42 and 44, respectively, (as illustrated in the figure) extend transverse to the axis of the ring 40. Faces 42 and 44 are parallel extending and flat. A gap 48 is formed by the interior wall 46 of the spacer ring 40. In the illustrated embodiment the gap 48 is empty of solid material and is referred to in the industry an "air gap". The gap thickness can be quite small, on the order of 0.5-1.0 mm. The introduction of the gap markedly reduces the heat transfer to the energetic material that occurs during ohmic heating.

As pointed out above, the semiconductor bridge 30 operates such that stray current will only result in resistance heating and will not cause the device to function in the plasma mode. The air gap 48 is dimensioned such that the semiconductor bridge is separated sufficiently away from the explosive material whereby stray energy will not initiate the energetic material. In this manner the initiator system can be safely used in high stray energy environments.

Figure 2:
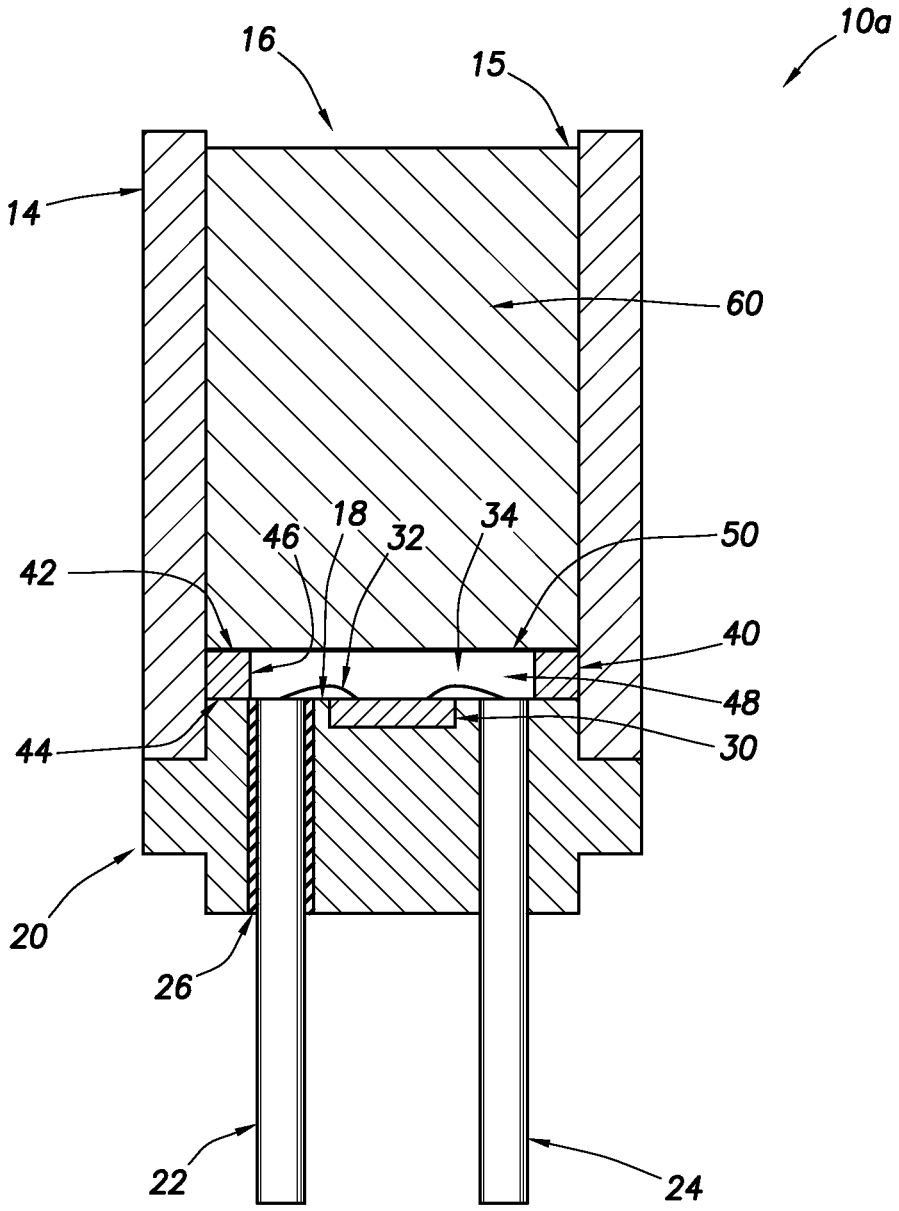
FIG. 2 is a diagram of another embodiment of the igniter system of the present invention illustrated in longitudinal section.

In an alternate embodiment illustrated in FIG. 2, a reactive layer 50 spans the interior of the barrel 14 and abuts the wall 46 of spacer ring 40. Conventional energetic material 60 substantially fills the interior of the barrel 14 from the open end 16 to the reactive foil 50. In this configuration the reactive layer 50 faces the semiconductor bridge 30 embedded in the header 20 and can be ignited by the plasma event of the semiconductor bridge 30. The term "reactive layer" as used herein refers to a thin layer of self-sustaining exothermic explosive material which requires a relatively high energy input to initiate the explosion. Reactive layers include pyrotechnic foils and the like.

According to one example of the present invention the reactive layer 50 comprises laminated reactive foil made by vapor-deposited alternating layers of Aluminum (Al) and Nickel (Ni) which when subjected to a heat pulse produces and self-sustaining exothermic reaction.

According to another embodiment the reactive layer 50 is between about 60 to 150 micrometers thick. The thickness of a layer 50 is inversely related to the gap spacing between the layer 50 and the semiconductor bridge 30.

In a further example the reactive layer 50 is a laminate comprises one or more layers selected from the group consisting of nickel-aluminum, aluminum-titanium, and titanium-amorphous silicon.

According to another example of the present invention the layer 50 comprises a reactive foil.

In a further embodiment the layer 50 comprises NanoFoil® distributed by Indium Corporation.

According to a further example embodiment, the layer 50 comprises materials that will not ignite unless the layer is heated to at least 250 degrees C. at a rate of at least 200 degrees C./min. Further, the layer when heated below the ignition rate will anneal and lose the ability to create a self-sustaining reaction.

Figure 3:
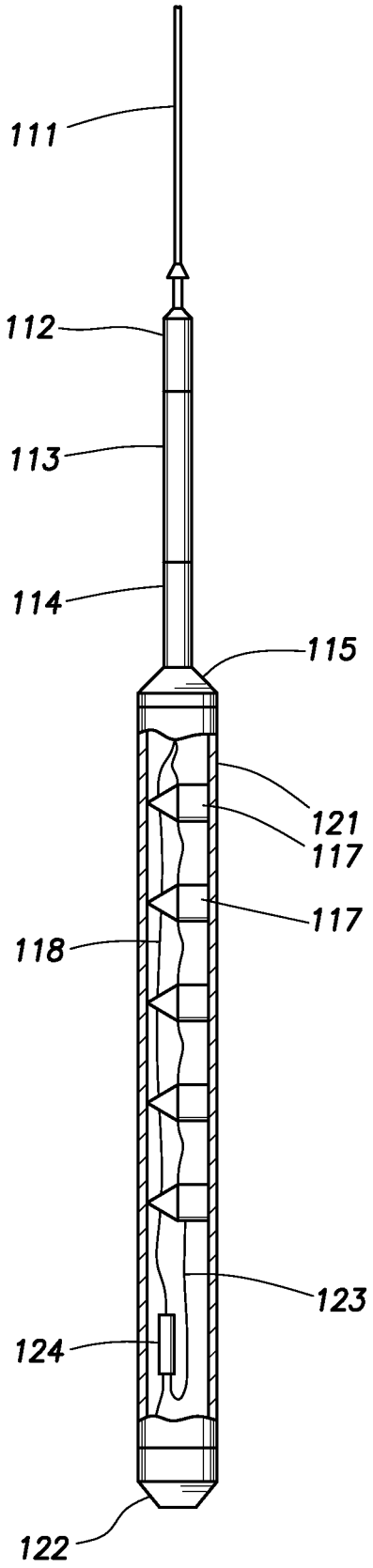
FIG. 3 is a partial section view on a downhole well tool including the electro-explosive initiating system of the present invention.

In FIG. 3 an example of an application of the igniter of the present inventions. Numeral 110 identifies a perforating gun assembly adapted to be lowered in a well for conducting perforating operations with shaped charges. This includes a wireline 111 of substantial length which includes a current conducting member as well as a strength member.

The wireline 111 is connected to a cable head 112. In turn, that is connected with a collar locator 113. The collar locator 113 locates collars in the casing and thereby provides an electrical signal of the location of the shaped charge perforating gun assembly 110 to the surface to enable proper positioning of the apparatus in the borehole. A casing collar locator is well known in the art.

The apparatus further includes a firing sub 114 connected below the collar locator 113 and in turn that is connected with a firing head 115. The firing sub and firing head combination incorporates a firing circuit (not shown).

The system further includes an elongate cylindrical sealed housing 121 which is closed with a bull plug 122 and which supports a number of shaped charges 117 therealong. The several shaped charges are all detonated by means of an explosive signal provided over a detonating cord 118.

The detonating cord is initiated with a detonating signal from an electro-explosive initiator 10. A wire 123 provides an electrical current flow from the firing circuit to the initiator 10. The several shaped charges are fired to form perforations through the surrounding casing and into the adjacent formations Operation of the igniter system 10 will be described when attached to a firing circuit (not shown) and installed in a down hole well tool, such as, an oilfield perforation system (not shown). Firing is initiated by applying a DC voltage across the leads of firing circuit, which causes a firing capacitor in the circuit to charge up until a fixed discharge voltage is reached. Upon reaching the discharge voltage the capacitor discharges current onto leg wires 22 and 24 causing the semiconductor bridge 30 to vaporize. Energy in the form of plasma gases are generated when the bridge 30 vaporizes. The plasma gases propagate across the gap 48 and cause the reactive foil 50 to ignite. The ignited foil 50 initiates the energetic material 60 which in turn initiates the perforating guns via a detonating cord or the like.

When the explosive foil 50 comprises NanoFoil®, ignition of the foil will not occur unless the semiconductor plasma heats the foil to at least 250 degrees C. in a rate of at least 200 degrees C./min. The semiconductor bridge is selected with a plasma event sufficient to create heating of the foil above the minimum. However, stray electromagnetic energy that induces current in the firing circuit will not cause the semiconductor bridge to vaporize and will instead merely result in resistance heating in the bridge. This lower rate of energy release (resistance heating) will cause the foil to remain unaffected or, at most, to anneal and loose its ability to ignite.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An initiator apparatus for detonation of an explosive, the initiator comprising:

a housing;

a reactive element located in the housing;

a semiconductor bridge located in the housing configured to form a plasma gas upon application of a sufficient electrical charge; and an air gap positioned between the reactive element and the semiconductor bridge element, wherein the air gap is dimensionally configured to prevent stray energy from igniting the reactive element during transfer of the stray energy.

2. The initiator apparatus of claim 1, wherein the air gap between the reactive element and the semiconductor bridge element is an open space absent solid materials.

3. The initiator apparatus of claim 1, wherein the reactive element comprises a reactive layer configured to ignite when heated by the plasma gas to at least about 250 degrees Celsius (C.) at a rate of at least about 200 degrees C./minute, wherein the air a is located between the reactive layer and the semiconductor bridge element.

4. The initiator apparatus of claim 1, wherein the semiconductor bridge is heated b resistance heating during transfer of the stray energy.

5. The initiator apparatus of claim 1, wherein the air gap comprises a thickness of about 0.5 mm to about 1.0 mm.

6. The initiator apparatus of claim 1, wherein the air gap is configured to reduce the transfer of heat to the reactive element during ohmic heating.

* * * * *